United States Patent [19]

Scott et al.

[11] Patent Number: 4,902,055

[45] Date of Patent: Feb. 20, 1990

[54] BUNDLING STRAP SECURITY STRUCTURE

[75] Inventors: Ernest D. Scott, Delray; Gregory W. Scott, Jacksonville Beach, both of Fla.; Donald L. Tedder, Carrollton, Ga.

[73] Assignee: Edge Technology Corporation, Boca Raton, Fla.

[21] Appl. No.: 303,464

[22] Filed: Jan. 30, 1989

[51] Int. Cl.[4] ..... B65D 33/34

[52] U.S. Cl. ..... 292/319

[58] Field of Search ..... 292/307, 312, 315–326; 24/16 PB

[56] References Cited

U.S. PATENT DOCUMENTS

| | | | |
|---|---|---|---|
| 1,655,424 | 4/1928 | Strahm | 292/324 |
| 2,977,145 | 3/1961 | Rifkin | 292/321 |
| 3,022,557 | 2/1962 | Logan | 24/16 PB |
| 3,186,047 | 6/1965 | Schuester et al. | 24/16 PB |
| 4,306,745 | 12/1981 | Wenk | 292/318 |

*Primary Examiner*—Richard E. Moore

*Attorney, Agent, or Firm*—Malin, Haley, McHale, DiMaggio & Crosby

[57] ABSTRACT

A bundling strap of the type having an apertured head portion with an embedded resilient tongue, to receive and secure a strap therein, an end of the strap being attached to the head portion, and a security cap comprising a four-sided housing surrounding the head portion, and having body segments which when moved relative to each other will fracture apart so as to expose tampering.

5 Claims, 1 Drawing Sheet

BUNDLING STRAP SECURITY STRUCTURE

BACKGROUND OF THE INVENTION

1. Field of the Invention

The present invention relates to bundling or tie straps of the character disclosed in Pat. No. 3,022,667, issued to M. C. Logan, and more particularly relates to a securing means for shielding the strap/self-clinching improvement from external access which may lead to unauthorized release of the bundled item(s).

2. Prior Art

Plastic bundling straps adapted to be looped about a plurality of elements or a pouch opening and drawn taut thereon in self-clinching relation are well-known.

Bundling or tie straps of this nature are comprised of an elongated flexible strap adapted to be wrapped around a plurality of items to be bundled or about a pouch to be sealed (i.e.: cloth bank or money-carrying bag), pulled taut and held taut by a relatively rigid tongue means disposed within the head-end of the strap. The head-end has a through-aperture therein adapted to receive the opposite or tail-end of said strap, said head-end further housing said tongue means adapted to coact with the tail end of said strap so as to retain the strap against movement thereof.

An example of a tie strap or bundling strap of this nature is disclosed in U.S. Pat. No. 3,186,047 to Schwester, et al. However, the apertured head end portion having the self-clinching tongue means is exposed to tampering. Tampering may be accomplished by removing the tongue means from clinching engagement with the strap body using a thin, sharp implement, and slipping the strap out of the aperture in the head-end. This would allow the bundled items to be unbundled or the closed pouch to be opened and access gained to the interior thereof. Thereafter the items may be rebundled or pouch reclosed using the same strap without there being evidence of tampering.

A principal object of the invention is to provide a tamper-proof self clinching bundling strap.

It is a further object of the present invention to provide a tamper-proof self-clinching bundling strap wherein the body portion thereof is adapted to be locked against reverse movement throughout its length, when looped upon itself and drawn through the apertured head-end portion of the strap, head-end portion being associated with security cap means which is designed to fracture when tampered with.

It is a still further object of the present invention to provide a novel security cap means for use in connection with a bundling strap, said security cap means serving to deter or preclude tampering with the bundled item.

SUMMARY OF THE INVENTION

A tamper-proof self clinching bundling strap is disclosed comprised of a conventional bundling strap having a self-clinching means therein, preferably comprised of a semi-rigid tongue means disposed within the head end of said bundling strap at an oblique angle wherein the body portion of the strap can be passed by said tongue means at an obtuse angle but is restrained against removal thereof in the opposite direction by direct frictional engagement between said tongue means and said strap body. The end of the tongue means is adapted to dig in to the resilient material of the strip to prevent removal of said strip once inserted through a through-aperture in the head end.

In order to prevent unwanted tampering of the tongue means by an unauthorized effort to remove the body of said strap to allow un-bundling, the instant invention provides a security cap comprised of a generally flat sheet of semi-rigid or rigid material, such as aluminum or metal alloy, bent along transverse axes into a three-dimensional near rectangular member having a bottom side, front side, rear side, and top side. Detents are provided along the transverse axis where the bends are made so as to cause the cap body to fracture therealong if the cap is opened to loosen or undo the strap. Through openings are provided in said cap which correspond with the positions through which the bundling strap is passed in use.

The security cap precludes access to the tongue means, thereby preventing anyone from tampering with said tongue means in an unauthorized effort to open the pouch or unbundle the bundled articles. The cap also, by incorporating said detents along the axes of bending of the cap, will fracture or break along those axes if someone attempts to open the cap to gain access to the tongue means. The invention provides a heretobefore much needed improvement in the industry related to transportation of currency in pouch-like containers (i.e.: bank bags and the like).

shows a bundling strap in association with the security cap, with the security cap shown in cross-section.

Figure 4:
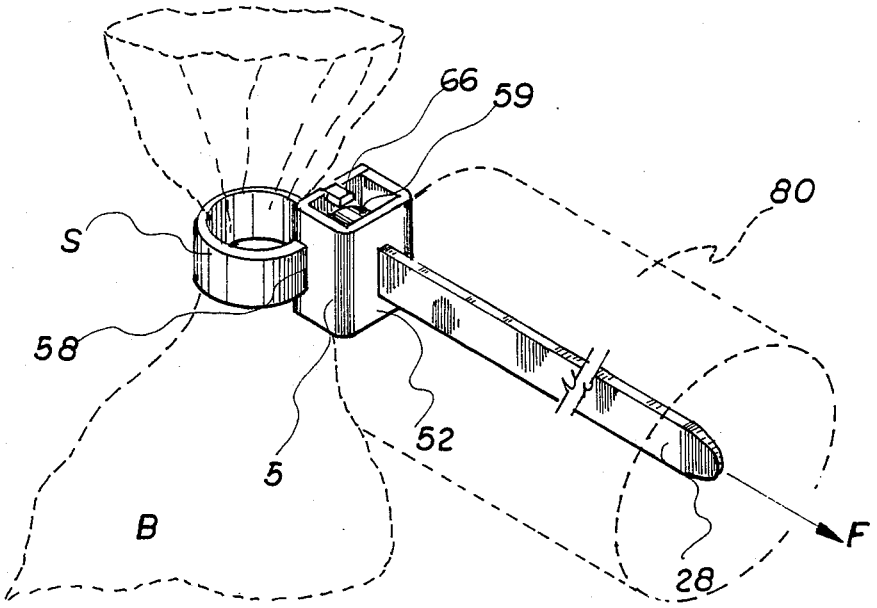

FIG. 4 shows a perspective view of the invention being used in association with a typical bank or currency bag (in phantom).

DETAILED DESCRIPTION OF THE PREFERRED EMBODIMENT

Referring to the drawings, the improved bundling or tie-strap S, of molded or extruded nylon for example, comprises an elongated body portion 10 having a flat upper surface 12, a flat or convex bottom surface 14, and parallel marginal edges 16.

The bottom surface 14 of the body portion 10 of the strap S may include a pair of spaced, parallel, relatively narrow ribs which extend throughout the major length thereof. Either surface 12 or 14 may be provided with small, spaced parallel projections, extending transversely thereof to provide a short finger gripping surface thereon.

The head-end portion 24 of strap S defines a clinching eyelet 26 adapted to receive the opposite end 28 of strap S. Eyelet 26 is sized and shaped to correspond to the cross-sectional area of the body portion 10 of the strap.

Figure 3:
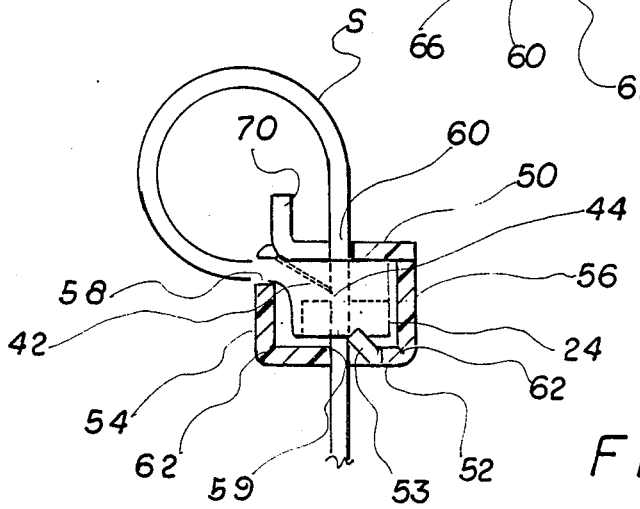

As best seen in FIG. 3, a thin, flat flexible pawl-like member or tongue means 42, preferably of stainless steel or aluminum is positioned within head-end 26 and at an acute angle to the axial center of eyelet or aperture 26. The free end portion of the pawl-like member or tongue means 42 presents an angular or beveled end face defining a line or knife edge 44, which extends into the eyelet 26, transversely of and across its axial center. Thus, when the body portion of the strap S is looped upon itself and drawn through the eyelet portion 26, the projecting free end 44 of the tongue 42 will flex as the looped body portion of the strap is drawn over the same but will react and bite into the said body portion 10 and thus lock the same against relative reverse movement in response to the strap being placed under tension.

It is to be noted that the angle of the tongue means 42 relative to the axial center of the eyelet 26 is such as to provide maximum ease of entry of the straps into and through the eyelet 26, while providing optimum retention force when locked against relative reverse movement of strap S.

Figure 1:
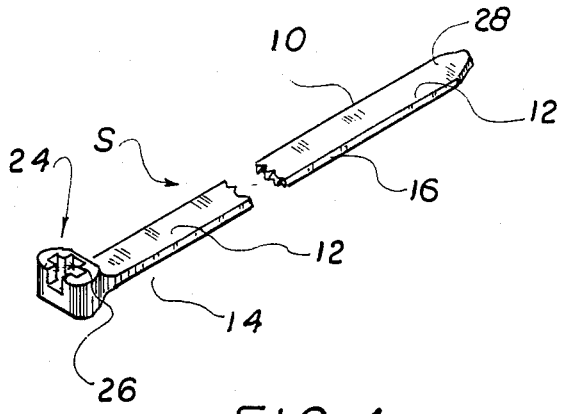
FIG. 1 is a perspective view of a conventional bundling strap.
Figure 2:
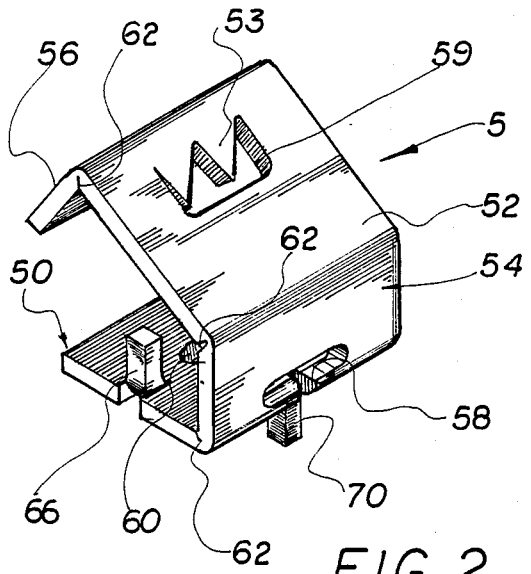
FIG. 2 is a perspective view of the security cap invention.

The inventive improvement herein is embodied in a security cap 5 as shown in FIGS. 2 through 4 and comprises a flat sheet of semi-rigid or rigid material, such as aluminum or stainless steel, bent along transverse axes into a three dimensional near rectangular member having a bottom 50, a top 52, a front side 54 and rear side 56. Detents 62 are preferably provided along the bend axes by removing material therefrom. Removing such material causes the cap to fracture or break along said axes when any of portions 50, 52, 54 or 56 are moved relative to each other, as when one attempts to open said cap from its enclosing engagement about head-end 26, as shown in FIGS. 3 and 4. Thus it can be seen that the material out of which cap 5 is made should be selected to fracture along detents 62 when the cap is moved out of the position shown in FIGS. 3 and 4. In this manner, anyone attempting to serruptitiously tamper with the seal strap 10 must remove cap 5, which will, however, cause cap 5 to break at either detent 62.

It should be noted that cap 5 is provided with inwardly bent gripping projections 53 disposed in surface 52. Said projections 53 have relatively sharp, pointed edges 53' which engage the top surface 12 of strap body 10 when the strap is drawn through eyelet 26 using tightening means 80, in a manner to be described hereinafter. If desireable, individual tie straps S may each be provided with respective identification indicia, preferably on top surface 12. Therefore, any attempt to pull strap S through cap 5 when closed will cause teeth 53 to mutilate said identification indicia, giving further indication of tampering.

As shown in FIG. 2, through openings 58, 59 and 60, adapted to receive strap S, are provided in cap 5. Opening 60 is disposed in bottom 50, opening 58 is disposed in front side 54, and opening 59 being disposed in top 52.

The security cap 5 is sized and shaped to cooperate with strap S as follows:

Tail-end 28 of strap S is fed into through-opening 58 and head-end 26 being seated within cap 5 as seen in FIG. 4. Tail-end 28 is thereafter looped upon itself and threaded into through opening 60 and eyelet 26 where strap body 10 drags across tongue means 42. During this process the cap 5 is in its semi-opened position shown in FIG. 2 wherein strap body 10 is free to pass through opening 59 with minimal interference from sharp projections 53.

The looped strap S is then placed about bag B or other item(s) to be bundled and drawn tight by any convenient tightening means 80. In the preferred embodiment, tightening means 80 is a power actuated automatic device having a means for gripping tail-end 28 of strap S and pulling thereon. Once bag B is fully bundled, the drawing action of tightening means 80 is brought into abutting contact with top surface 52, thereby closing cap 5 from its semi-open state shown in FIG. 2 to its closed state shown in FIGS. 3 and 4. This closing movement causes projections 53 to engage strap body 10 in biting engagement to lock cap 5 in its securing position about head-end 26.

Once cap 5 is closed about head-end 26, any attempt to reopen same will result in either cap body members 50, 52, 54 or 56 snapping off fracturing or otherwise becoming disfigured along either detent 62. Such a happenstance will result in an immediate indication of tampering so that appropriate steps may be taken against the custodians of bag B.

Cap 5 also preferably has associated therewith an outwardly extending projection 70 which is sized and shaped to engage bag B when cap 5 is in use (FIG. 4) so that little or no twisting motion of the cap 5/strap S combination is permitted while in use. Projection 70 may be stamped into cap body 5 when cap body 5 is formed or may be connected thereto through welding, soldering, etc.

Side projections 66 may also be provided to further preclude access to head-end 26 and tongue means 42, thereby rendering said cap 5 secure against virtually any tampering activity whatsoever. The principal aim of side projections 66 is to prevent the unwanted removal of the subject tie wrap S, which if permitted, would enable one to gain access to the contents of the bag and reseal the opening thereof with a new tie wrap.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A combination self-clinching bundling strap and security cap means therefore for bundling bank bags, comprising:

a self-clinching bundling strap having a head-end portion, a tapered tail-end portion and a body portion therebetween, said head-end portion defining a transverse aperture therethrough, said aperture having an axial center and a resilient semi-rigid tongue having one end portion thereof imbedded in said head-end with its opposite end portion extending into said aperture and across the axial center thereof at an acute angle thereto presenting a line edge transversely of the axial center of said aperture adapted for locking the body portion of said strap against relative reverse movement when looped upon itself and fed through said aperture, a security cap means comprised of a four-sided housing means adapted to surround said head-end portion in securing engagement and having body segments which when moved relative to each other will fracture apart so as to expose said head-end to tampering.

2. The combination of claim 1, wherein said security cap means defines three through apertures in three of its four sides, said through apertures sized and shaped to receive said strap body portion when said strap is looped upon itself and fed through said aperture in said head-end portion.

3. The combination of claim 2, wherein two of said through apertures in said cap means are aligned axially with said aperture in said head-end portion.

4. The combination of claim 3, wherein one of said two through apertures in said cap means has associated therewith at least one inwardly bent projection means for assuming biting engagement with said body portion of said strap when said cap means is disposed in securing relation about said head-end portion.

5. The combination of claim 5, further comprising a pin member projecting outwardly from said cap means adapted to penetrate the bank bag being bundled.

* * * * *